US008141734B2

(12) United States Patent
Wang et al.

(10) Patent No.: US 8,141,734 B2
(45) Date of Patent: Mar. 27, 2012

(54) INDUCTION ACTUATION CONTAINER WITH RECHARGEABLE POWER SUPPLY

(76) Inventors: Xin Wang, Fujian (CN); Jiangqun Chen, Fujian (CN)

( * ) Notice: Subject to any disclaimer, the term of this patent is extended or adjusted under 35 U.S.C. 154(b) by 375 days.

(21) Appl. No.: 12/454,612

(22) Filed: May 19, 2009

(65) Prior Publication Data

US 2010/0294766 A1 Nov. 25, 2010

(51) Int. Cl.
*B65D 55/00* (2006.01)

(52) U.S. Cl. ..... 220/211; 361/752

(58) Field of Classification Search ..... 220/211
See application file for complete search history.

(56) References Cited

U.S. PATENT DOCUMENTS 4,729,490 A * 3/1988 Ziegenbein ..... 220/211
5,262,768 A * 11/1993 Florer ..... 340/815.73
5,685,501 A * 11/1997 Wagner ..... 241/169.1
5,932,982 A * 8/1999 Pezzelli, Jr. ..... 318/480
6,120,162 A * 9/2000 Guerrieri ..... 362/155
6,596,983 B2 * 7/2003 Brent ..... 250/221
6,812,655 B1 * 11/2004 Wang et al. ..... 318/3
7,598,693 B2 * 10/2009 Wang et al. ..... 318/468
7,714,527 B2 * 5/2010 Wang et al. ..... 318/480
7,750,591 B2 * 7/2010 Wang et al. ..... 318/480
7,781,995 B2 * 8/2010 Yang et al. ..... 318/266
7,906,921 B2 * 3/2011 Wang et al. ..... 318/266
2006/0196874 A1 * 9/2006 Yang ..... 220/211
2006/0255033 A1 * 11/2006 Yang et al. ..... 220/211
2010/0133286 A1 * 6/2010 Wang et al. ..... 220/822
2011/0017735 A1 * 1/2011 Wang et al. ..... 220/211

* cited by examiner

*Primary Examiner* — Lisa Lea Edmonds
(74) *Attorney, Agent, or Firm* — Raymond Y. Chan; David and Raymond Patent Firm

(57) ABSTRACT

A container includes a container body having a receiving cavity and a container opening communicating with the receiving cavity, a cover panel movably coupled mounted at the container opening to fold between a closed position and an opened position, and an induction actuation system. The induction actuation system includes an actuation unit to automatically drive the cover panel moving between the closed position and the opened position in responsive to a presence of a user and a power recharging arrangement which includes a battery unit detachably supported by the container body, wherein the battery unit is mounted at the container body to electrically connect to the actuation unit for resuming proper operation thereof and is detached from the container body for recharging purpose.

17 Claims, 7 Drawing Sheets

INDUCTION ACTUATION CONTAINER WITH RECHARGEABLE POWER SUPPLY

BACKGROUND OF THE PRESENT INVENTION

1. Field of Invention

The present invention relates to a container, and more particularly to an induction actuation container with a rechargeable power supply, which is capable of allowing a user to conveniently and promptly detach the rechargeable battery from the container and recharge it for future use.

2. Description of Related Arts

A conventional container for storing predetermined objects, such as a trash container, usually comprises a container body having a receiving cavity formed therein, and an opening communicated with the receiving cavity, and a cover panel movably mounted on top of the container body for selectively opening and enclosing the receiving cavity for allowing the user to dispose predetermined objects into the container body. When the container is not in use, the receiving cavity is substantially enclosed for physically separating the objects disposed in the receiving cavity from an exterior of the container.

In a number of situations, such as when a person is holding a lot of trash in both of his hands, it is inconvenient or difficult for the person to lift up the cover panel in that the person simply does not have spare hands to lift up the cover panel. If the person nevertheless tries to lift up the cover panel, he risks dropping all the trash in his or her hands onto the floor.

In recent years, electrically-operated containers have been developed in which the cover panel is largely driven by electrical components so as to achieve automatic opening or closing of that cover panel. For most of these electrically-operated containers, such as electrically-operated trash cans, a sensor is utilized for detecting a target movement, such as a movement of the person throwing trash, in a detection range, so that when that person stands in that detection range, the sensor will send a signal to the relevant electrical components so as to automatically lift up the cover panel, and when the user has left the detection range, the sensor will send a corresponding signal to those electrical components for automatically lowering down the cover panel so as to close the container.

There are a number of disadvantages in relation to this kind of electrically-powered containers. First, virtually all electrically-powered containers employed some sorts of sensors for detecting user's position so as to determine the exact time at which the cover panel is to be automatically actuated. However, the position of the sensors with respect to the corresponding container body may not be optimal so that the cover panel may be unnecessarily lifted up. This result may also occur when the sensor is too sensitive. Conversely, when the sensor is too insensitive, there may occur a situation where the cover panel does not lift up when in fact it is necessary.

Second, virtually all of the above mentioned electrically-powered containers comprise some sort of batteries installed therewithin for providing power to the electrical components driving the cover panels. Since the appearance of the container must be maintained and that the electrical components of the container must be protected, the batteries are usually not easily accessible from outside of the containers. As a result, when the battery runs out of electricity, the user has to disassemble the container and take out the battery for recharging or replacement. When a recharged or new battery is available, the user has to manually re-install the battery back to the container and re-assemble the container. All these procedures are inconvenient and time-consuming. When a large number of such containers are used, such as where the containers are extensively provided in a shopping mall or in a food court, the relevant staff has to spend a considerable amount of time in ensuring that the electrically-powered containers are properly operating.

SUMMARY OF THE PRESENT INVENTION

A main object of the present invention is to provide an induction actuation container comprising a power recharging arrangement which is capable of allowing a user to conveniently and promptly detach the rechargeable battery cell from the container and recharge it for future use.

Another object of the present invention is to provide an induction actuation container comprising a power recharging arrangement, which allows the user to conveniently access the rechargeable battery cell without disassembling the container. In addition, the user does not require moving the entire container from place to place for recharging the rechargeable battery cell.

Another object of the present invention is to provide an induction actuation container comprising a power recharging arrangement, which comprises a rechargeable facility adapted for recharging the rechargeable battery disposed in the container, wherein the rechargeable facility is also capable of simultaneously recharging a plurality of rechargeable batteries from different containers. In other words, rechargeable batteries from different induction actuation containers can be centrally and simultaneously recharged.

Accordingly, in order to accomplish the above objects, the present invention provides an induction actuation container, comprising:

a container body having a receiving cavity and a container opening communicating with the receiving cavity; and a cover panel movably coupled mounted at the container body at the container opening to fold between a closed position that the cover panel is folded to enclose the receiving cavity and an opened position that the cover panel is folded to expose the receiving cavity through the container opening;

The induction actuation container further comprises an induction actuation system, which comprises:

an actuation unit supported in the container body to automatically drive the cover panel moving between the closed position and the opened position in responsive to a presence of a user; and a power recharging arrangement which comprises a battery unit detachably supported by the container body, wherein the battery unit is mounted at the container body to electrically connect to the actuation unit for resuming proper operation thereof and is detached from the container body for recharging purpose.

These and other objectives, features, and advantages of the present invention will become apparent from the following detailed description, the accompanying drawings, and the appended claims.

DETAILED DESCRIPTION OF THE PREFERRED EMBODIMENT

Figure 1:
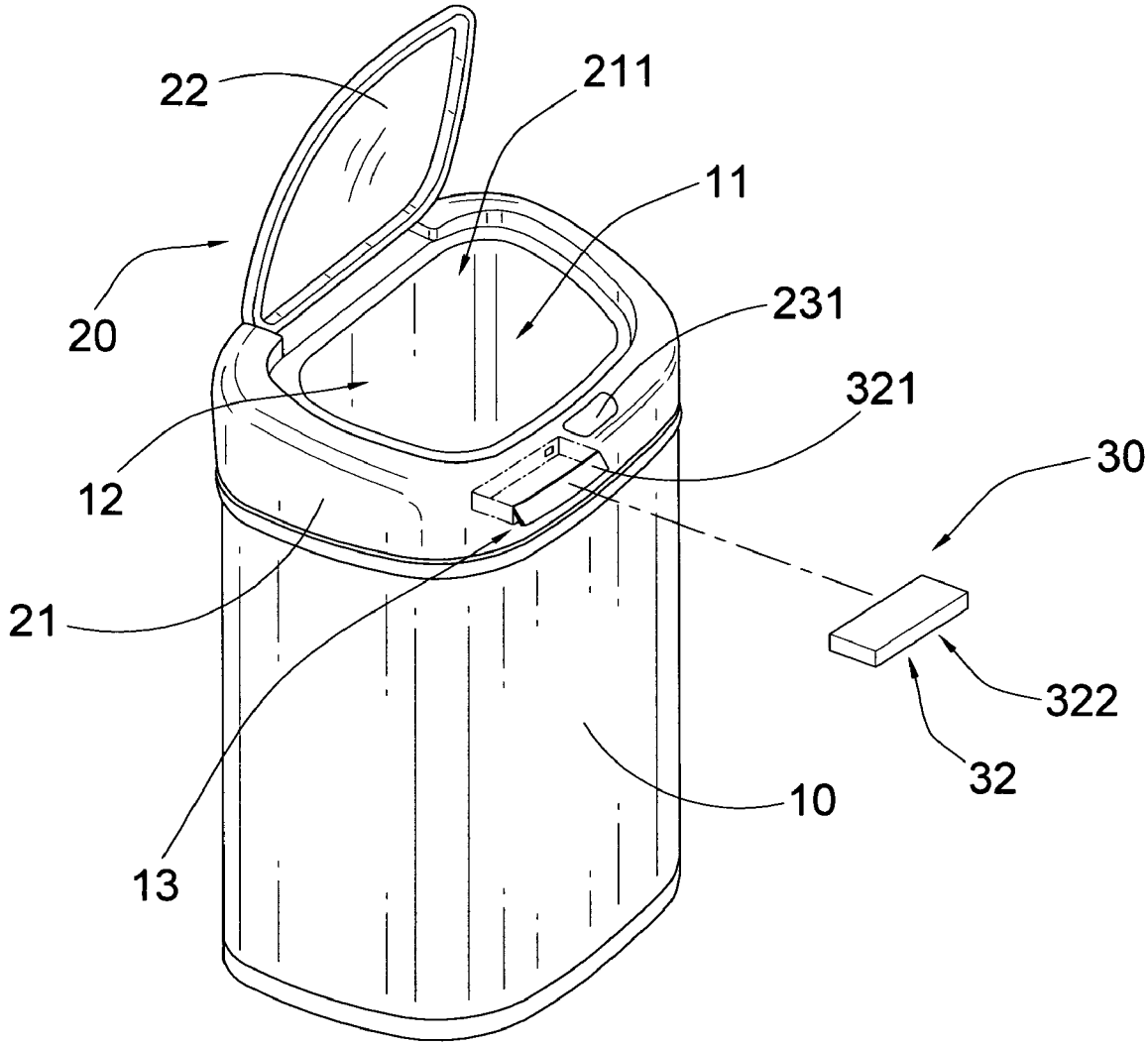
FIG. 1 is a perspective view of an induction actuation container according to a preferred embodiment of the present invention.
Figure 2:
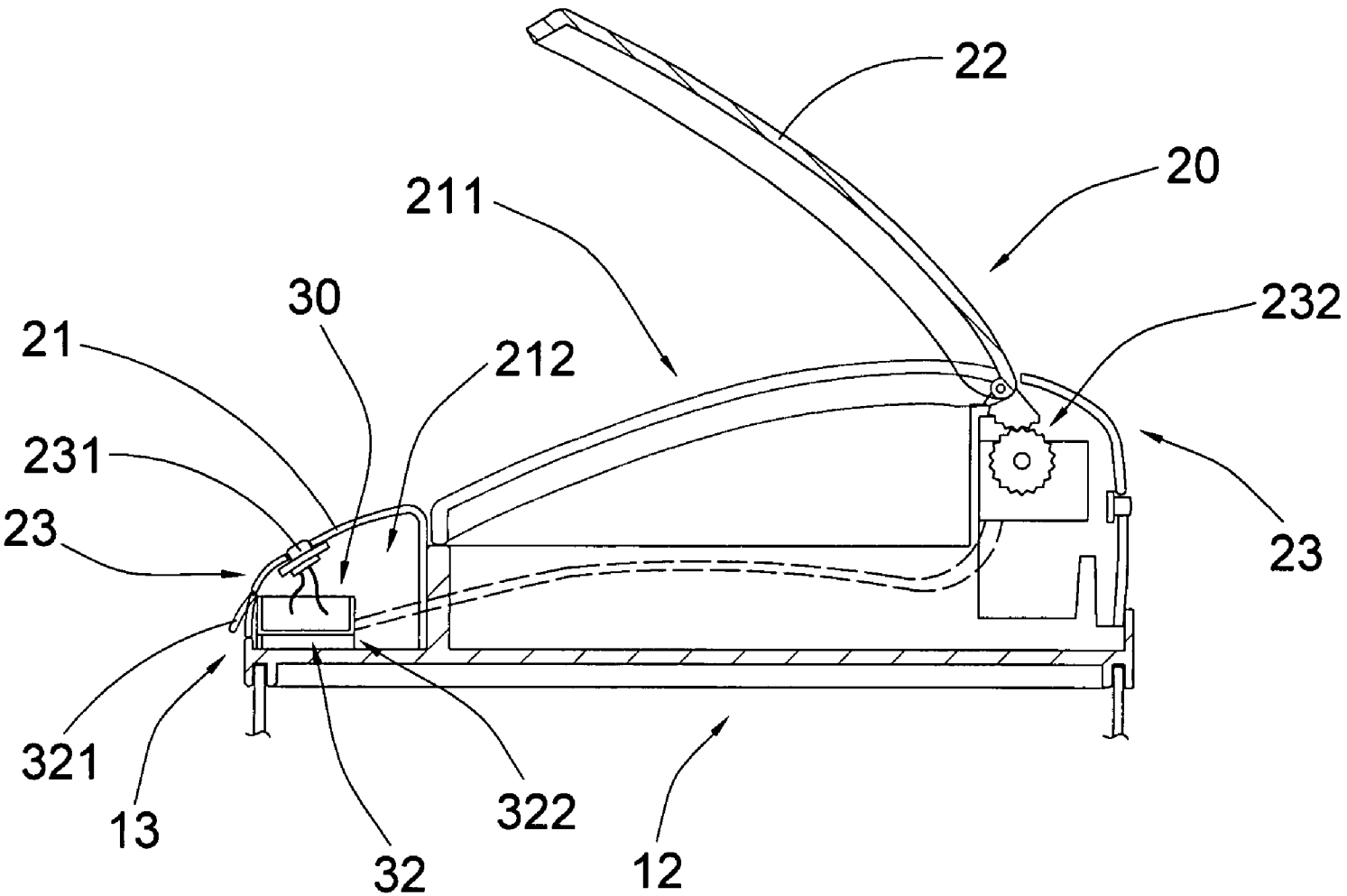
FIG. 2 is a sectional view of the induction actuation system of the induction actuation container according to the above preferred embodiment of the present invention.
Figure 3:
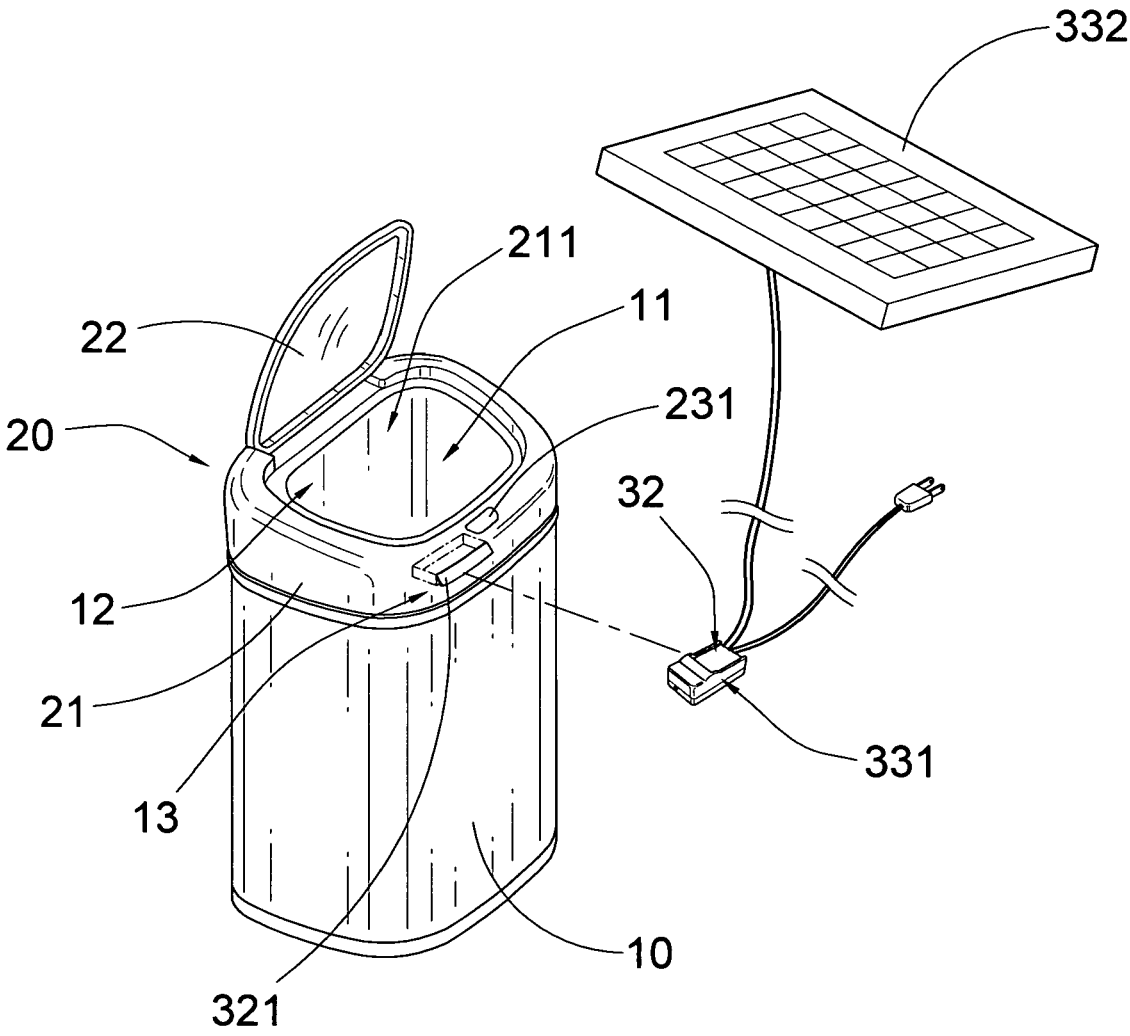
FIG. 3 is an exploded perspective view of the induction actuation container according to the above preferred embodiment of the present invention.

Referring to FIG. 1 to FIG. 3 of the drawings, an induction actuation container according to a preferred embodiment of the present invention is illustrated, in which the induction actuation container comprises a container body 10 having a receiving cavity 11 and a top container opening 12, and an induction actuation system. The induction actuation system comprises an induction actuation container cover 20 and a power recharging arrangement 30.

The induction actuation container cover 20 comprises a control housing 21 a cover panel 22, and an automatic driving arrangement 23. The control housing 21 has a cover opening 211 and mounted at the container body 10 at the container opening 12 thereof to communicate the cover opening 211 with the receiving cavity 11. Accordingly, the container body 10 has a top rim opening for the control housing 21 detachably coupling thereat.

The control housing 21 has an operation cavity 212 for receiving the power recharging arrangement 30 therein. The cover panel 22 is pivotally mounted to the control housing 21 to pivotally move between a closed position that the cover panel 22 covers at the cover opening 211 to enclose the receiving cavity 11 and an opened position that the cover panel 22 exposes the cover opening 211 for communicating with the receiving cavity 11.

The automatic driving arrangement 23 comprises a sensor 231 mounted on the control housing 21 for detecting a target movement of a user, and an actuation unit 232 supported in the control housing 21 to drive the cover panel 22 moving between the closed position and the opened position.

The power recharging arrangement 30 contains a user recharging slot 13 provided on the control housing 21 to communicate with the automatic driving arrangement 23, and comprises a battery unit. The battery unit comprises a rechargeable battery cell 32 detachably disposed in the user recharging slot 13 for electrically connecting with the automatic diving arrangement 23, and a recharging facility 33 adapted for connecting to an external power source, wherein when the rechargeable battery cell 32 needs recharging, the rechargeable battery cell 32 is adapted to be conveniently detached from the user recharging slot 13 and electrically connect with the recharging facility 33 for recharging, wherein when the rechargeable battery cell 32 is fully recharged, the rechargeable battery cell 32 is adapted to be inserted back into the user recharging slot 13 for electrically re-connecting the rechargeable battery cell 32 with the automatic diving arrangement 23 so as to resume proper operation thereof.

According to the preferred embodiment of the present invention, the user recharging slot 13 is formed on the control housing 21 in the vicinity of the automatic driving arrangement 23 so as to minimize the distance of electrical connection between the rechargeable battery cell 32 and the automatic driving arrangement 23. As such, the possibility of damage of the electrical connection between the automatic driving arrangement 23 and the rechargeable battery cell 32 can also be minimized. It is worth mentioning that the recharging slot 31 is preferably formed on a front side of the control housing 21 so that a user is able to easily access the rechargeable battery cell 32 for the front, i.e. without needing to turn around or turn over the container body 10. On the other hand, it can also be formed at the control housing 21 at the external wall thereof for normally hiding the rechargeable battery cell 32 to prevent unwanted access to the rechargeable battery cell 32.

Accordingly, the operation cavity 212 is an enclosed cavity that the receiving cavity 11 of the control housing 21 is inaccessibly communicating with the operation cavity, such that only the user recharging slot 131 is accessibly communicated with the operation cavity for the battery unit inserting thereinto.

The recharging facility 33 comprises a charger base 331 having at least one charging slot for electrically connecting with a power source, wherein the charging slot 311 is shaped and sized to fittedly receive the rechargeable battery cell 32 detached from the control housing 21. When the charger base 331 is electrically connected with an external power source, such as an external AC power source, the charger base 331 is adapted to recharge the rechargeable battery cell 32 in the charging slot. Accordingly, the charger base 331 further comprises a charging circuitry adapted for recharging the rechargeable battery cell 32 from an external power source, such as an external AC power source.

It is worth mentioning that the charger base 331 may comprise a plurality of charging slots spacedly provided thereon for centrally and comprehensively charging a corresponding number of rechargeable battery cells 32 from a number of induction actuation containers. For example, when a particular user, such as the management of a mall, utilizes a many induction actuation containers in the mall, the staff of the mall may conveniently detach the rechargeable battery cell 32 from each of the induction actuation containers and centrally recharge the rechargeable battery cells 32 at the charger base 331 which is positioned distant from the container body 10.

In order to further enhance the diversity of the power sources available for charging the rechargeable battery cell 32, the recharging facility 33 further comprises a solar energy panel 332 extended from the charger base 331 for collecting solar energy to recharge the rechargeable battery cells 32 inserted into the charging slots. More specifically, the solar energy panel 332 is electrically connected with the charging circuitry in such a manner that the collected solar energy is converted into electrical power for recharging the rechargeable battery cells 32 via the charging circuitry.

The power recharging arrangement 30 further comprises a battery cover 321 movably provided on the control housing 21 for normally covering the user recharging slot 13 while the rechargeable battery cell 32 is inserted therein. In other words, the battery cover 321 and the user recharging slot 13 constitute a concealed compartment for normally receiving and protecting the rechargeable battery cell 32, wherein the user is able to easily access the compartment by opening the battery cover 321 and detach the rechargeable battery cell 32 from the control housing 21. The detached rechargeable battery cell 32 can be recharged through the recharging facility 33.

Figure 4:
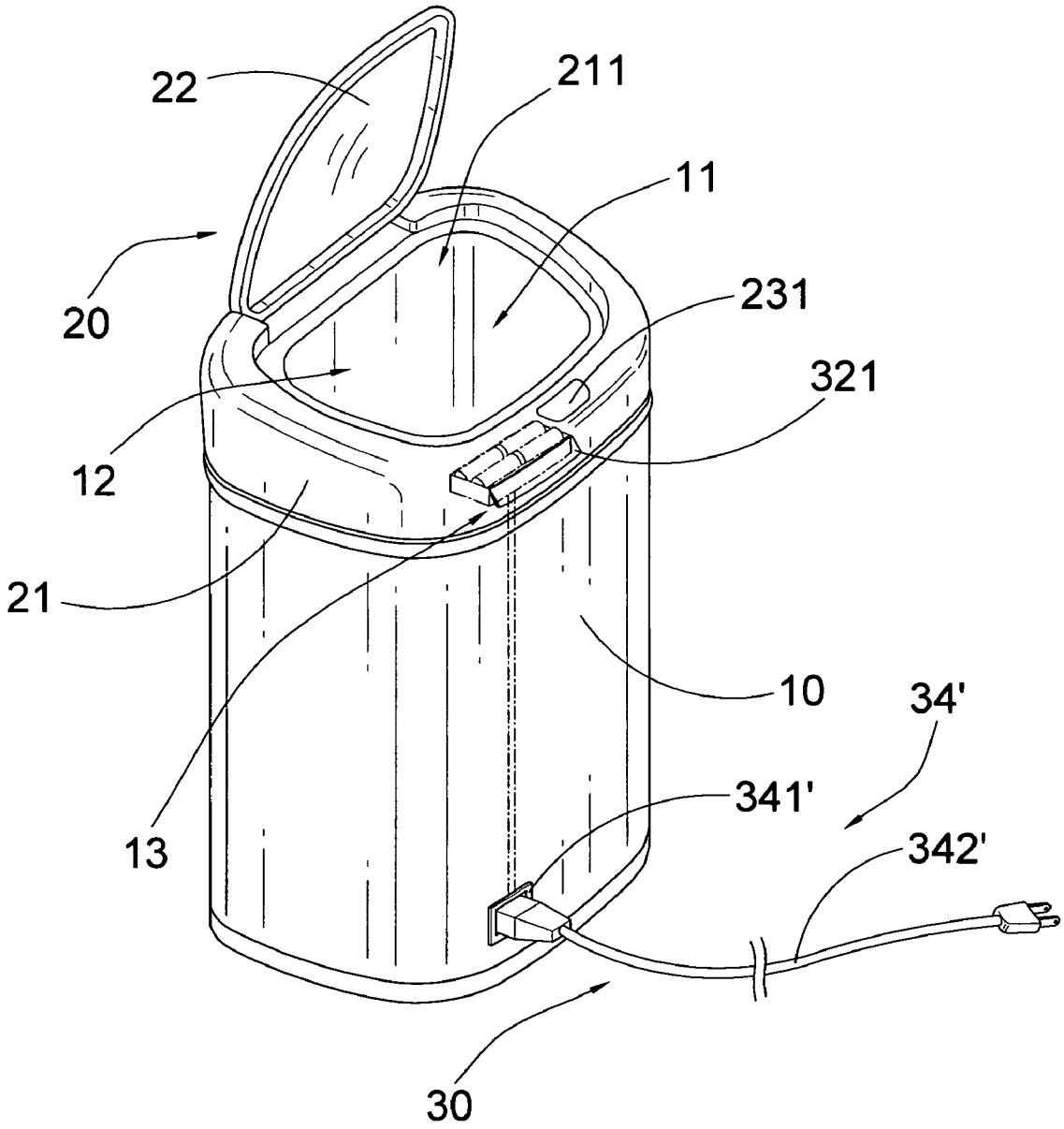
FIG. 4 is an alternative mode of the induction actuation container according to the above preferred embodiment of the present invention.

Referring to FIG. 4 of the drawings, as an alternative mode of the induction actuation container, the power recharging arrangement 30 comprises further comprises a power line unit 34' for electrically coupling the battery unit with an external power source, wherein said power line unit 34' comprises a terminal socket 341' provided at the exterior wall of the container body 10 to electrically couple with the actuation unit 232 and a power cable 342' having one end detachably connected to the terminal socket 341' and an opposed end adapted for electrically connecting with the external power source so as to charge the battery unit and to power the actuation unit 232 at the same time.

It is worth to mention that the power line unit 34' can incorporate with a retraction device such that the power cable 342' can be retractably extended from the control housing 21 to electrically connect with an external AC power source. Thus, a user is able to recharge the rechargeable battery 31' from a distance from an external AC power source.

Figure 5:
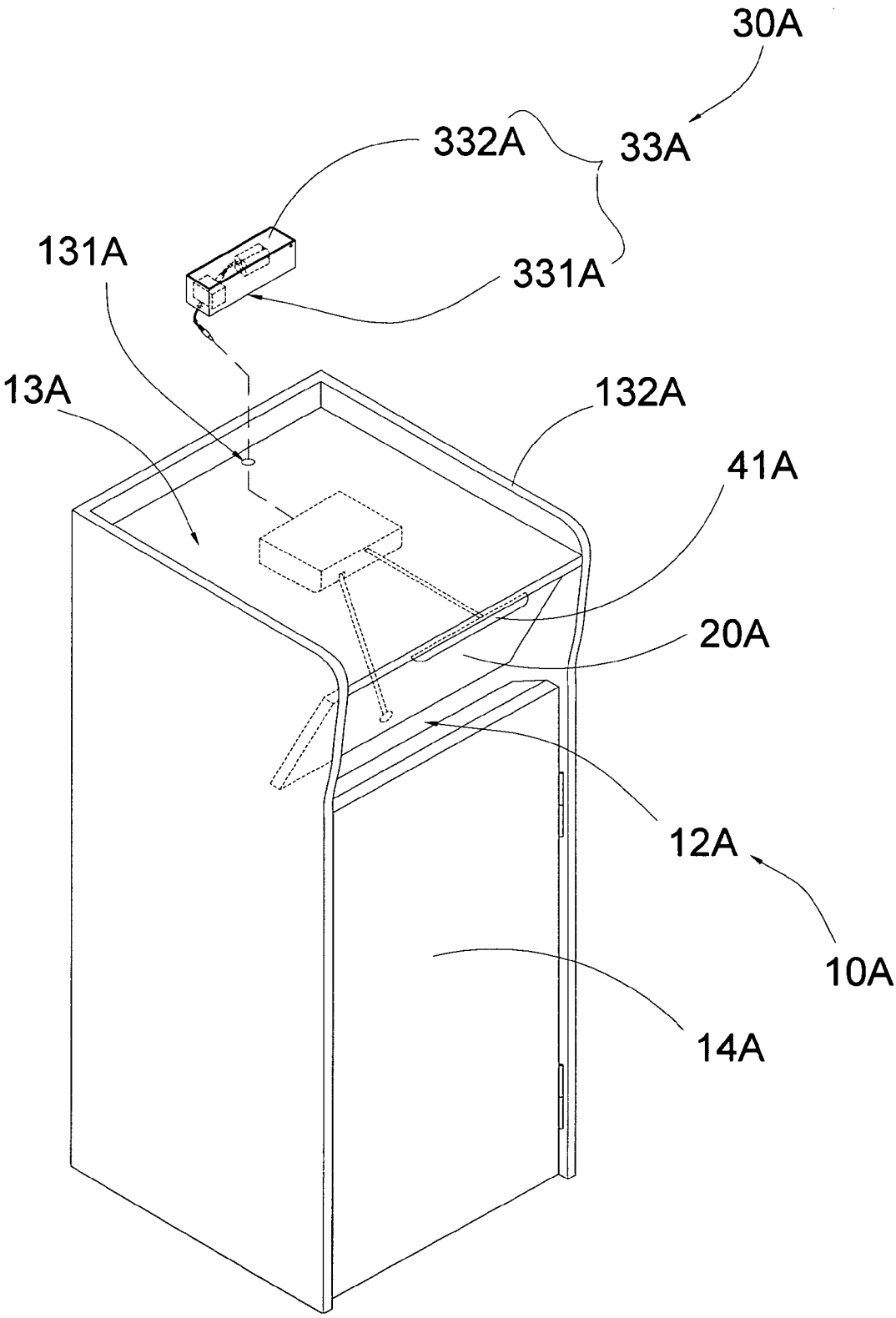
FIG. 5 is a perspective view of an induction actuation container according to a second preferred embodiment of the present invention.
Figure 6:
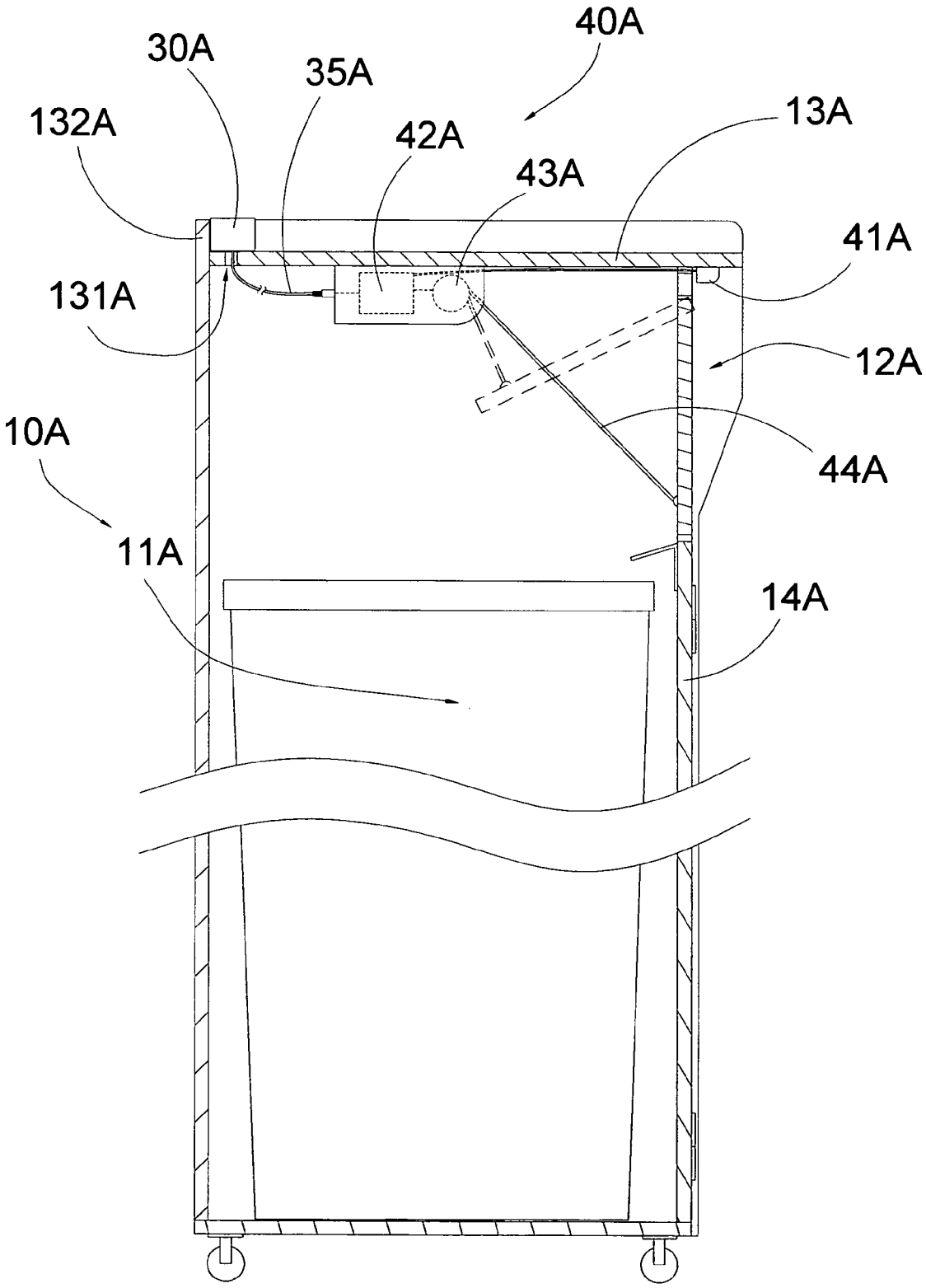
FIG. 6 is a sectional view of the induction actuation container according to the above second preferred embodiment of the present invention.
Figure 7:
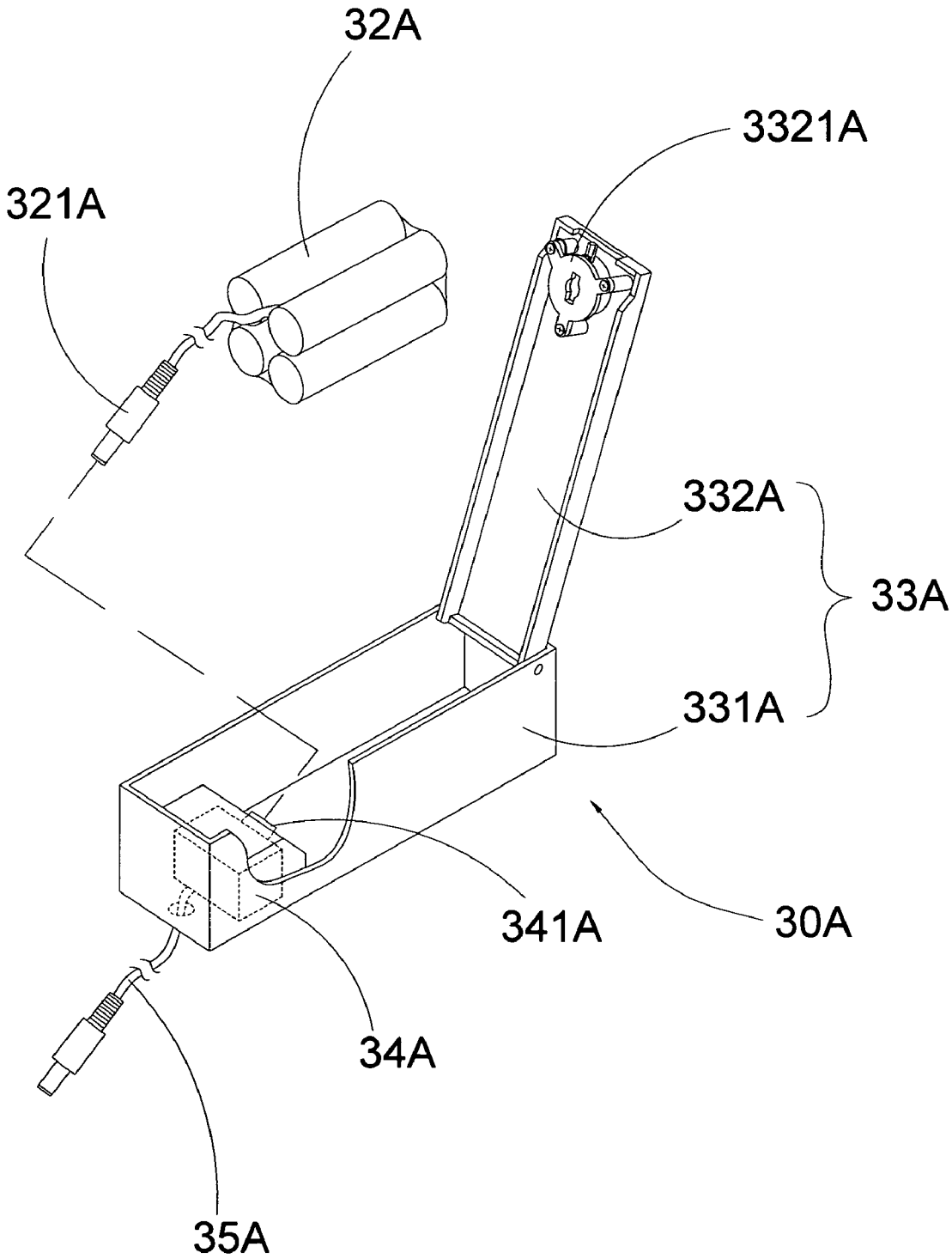
FIG. 7 is an exploded perspective view of the power recharging arrangement of the induction actuation container according to the above second preferred embodiment of the present invention.

Referring to FIG. 5 to FIG. 7 of the drawings, an induction actuation container according to a second preferred embodiment of the present invention is illustrated, wherein the induction actuation container comprises a container body 10A having a receiving cavity 11A and a container opening 12A provided at an upper front side of the container body 10A, a cover panel 20A pivotally coupled at the container opening 12A of container body 10A, and an induction actuation system. The induction actuation system comprises power recharging arrangement 30A and an actuation unit 40A electrically and operatively connected to the power recharging arrangement 30A.

The cover panel 20A is pivotally mounted at the container opening 12A to pivotally move between a closed position that the cover panel 20A is pivotally folded to cover at the container opening 12A so as to enclose the receiving cavity 11A, and an opened position that the cover panel 20A is pivotally folded to expose the container opening 12A for communicating with the receiving cavity 11A.

The cover panel 20A is pivotally coupled with the container body 10A at the container opening 12A, and is arranged to pivotally and rearwardly fold into the container body 10A at the opened position to communicate the container opening 12A with the receiving cavity 11A at a bottom portion of the container body 10A and to pivotally fold at vertical orientation at the closed position so as to enclose the container opening 12A.

The actuation unit 40A mounted underneath a top wall 13A of the container body 10A comprises a sensor 41A, which is preferably mounted underneath a front portion of the top wall 13A at a position in front of the cover panel 20A for detecting a target movement of a user, so that when the sensor 41A is activated by the movement of the user, the power recharging arrangement 30A is triggered to supply a power to the actuation unit 40A to drive the cover panel 20A moving from the closed position to the opened position.

It is appreciated that the sensor 41A is provided underneath the top wall 13A of the container 10A at a top outer peripheral edge of the container opening 12A, wherein the sensor 41A is capably of accurately detecting the target movement of the user. In order words, the sensor 41A is capably of detecting the target movement in a proper distance, to ensure the cover panel 12A being driven by the actuation unit 40A in the opened position for a predetermined objects being received in the container body 10A through the container opening 12A, when the target movement of the user is close enough to the cover panel 20A for being detected by the sensor 41A. Therefore, the sensor 41A will detect the object in front of the cover panel 12A at a predetermined detecting distance to prevent a false operation of the actuation unit 40A and to save the electrical energy of the power recharging arrangement 30A.

The power recharging arrangement 30A comprises a battery unit, which comprises a rechargeable battery cell 32A, a battery housing 33A detachably mounted on an outer side of the container body 10A for receiving the rechargeable battery cell 32A therewithin, and a power circuit 34A sealed and received in the battery housing 33A to electrically pre-wire with the actuation unit 40A. The rechargeable battery cell 32A is detachably disposed in the housing base 331A for electrically connecting to the actuation unit 40A, in such a manner that when the rechargeable battery cell 32A is electrically disconnected to the power circuit 34A, the rechargeable battery cell 32A is adapted to detach from the battery housing 33A for recharging purpose.

Accordingly, the battery housing 33A is preferably mounted on a rear portion and a top of the top wall 13A of the container body 10A. The battery housing 33A contains a housing base 331A securely mounted on the outer side of the container body 10A, wherein the housing base 331A has an accessing opening for accessing the rechargeable battery cell 32A within the housing base 331A of the battery housing 33A, and a housing cover 332A pivotally coupling with the housing base 331A for being pivotally flipped to access the rechargeable battery cell 32A in the housing base 331A, so as to securely seal and enclose the rechargeable battery cell 32A therein. Therefore, the housing cover 332A is movably provided on the housing base 331A for normally covering the housing base 331A of the battery housing 33A while the rechargeable battery cell 32A is disposed therein. In order words, the housing cover 332A and housing base 331A constitute a concealed compartment for normally receiving and protecting the rechargeable battery cell 32A, wherein the user is able to easily access the compartment by opening the housing cover 332A and detach the rechargeable battery cell 32A from the housing base 331A.

It is worth mentioning that the battery housing 33A preferably provided at the top of the top wall 13A of the outer side of the container body 10A is capable of conveniently and promptly reaching the rechargeable battery cell 32A within the battery housing 33A by the user, so as to enhance accessing and detaching the rechargeable battery cell 32A for recharging purpose. In order words, the user is able to easily access the rechargeable battery cell 32A without needing to turn around or turn over the container body 10A. In addition, since the battery housing 33A is located out of the receiving cavity 11A, the battery housing 33A will keep its clean and will allow the user to access the battery cell 32A without disassembling the container body 11A.

The housing cover 332A further comprises a locker member 3321A provided on a top side of the housing cover 332A to lock the housing cover 332A with the housing base 331A, and for securely enclosing and locking the rechargeable battery cell 32A within the housing base 331A of the battery housing 33A, so as to prevent the rechargeable battery cell 32A being stolen.

The rechargeable battery cell 32A further comprises a power plug 321A electrically and detachably connected to a power slot 341A of the power circuit 34A for electrically connecting to the actuation unit 40A, and arranged to be detached from the power slot 341A of the power circuit 34A for electrically connecting to an external power source for recharging purpose, in such manner that the rechargeable battery cell 32A is being detachably and electrically connected or disconnected to the actuation unit 40A through the power circuit 34A of the battery unit by detachably plugging or unplugging the power plug 321A of the rechargeable battery cell 32A with the power slot 341A of the power circuit 34A.

The battery housing 33A of battery unit further comprises a connection cable 35A extended from the power circuit 34A to detachably and electrically connect to the actuation unit 40A, so as to connect the actuation unit 40A to the power recharging arrangement 30A. The top wall 13A of the container body 10A has at least one through communication slot 131A formed thereat, wherein the connection cable 35A is electrically connecting the battery unit at the top wall 13A of the outer surface of the container body 10A with the actuation unit 40A underneath the top wall 13A through the communication slot 131A, so as to electrically supply the power from the power recharging arrangement 30A to activate the activation unit 40A.

Therefore, when the rechargeable battery cell 32A needs recharging, the rechargeable battery cell 32A is adapted to be conveniently detached from the housing base 331A and electrically connect with the external power source for recharging, wherein when the rechargeable battery cell 32A is fully recharged, the rechargeable battery cell 32A is adapted to be inserted back into the housing base 331A of the battery housing 33A for electrically re-connecting the rechargeable battery cell 32A with the power circuit 34A in the battery housing 33A, so as to resume proper operation thereof.

Accordingly, the actuation unit 40A further comprises an electric motor 42A electrically connected to the power recharging arrangement 30A and being activated by the sensor 41A, a driving pulley 43A being driven to rotate by the electric motor 42A, and an actuating cable 44A having one end coupling with the driving pulley 43A and an opposed end coupling with a lower portion of the cover panel 20A at an inner side thereof, wherein when the electric motor 42A is activated to drive the driving pulling 43A to rotate, the actuating cable 44A is wound around the driving pulley 43A to pull the cover panel 20A rearwardly so as to pivotally fold the cover panel 20A from the closed position to the opened position.

Accordingly, when the sensor 41A, which is electrically connected to the actuation unit 40A, is detecting the target movement of the user, the actuation unit 40A is being triggered to activate the electric motor 42A to rearwardly pull up the actuating cable 44A so as to pivotally fold the cover panel 20A into the container body 10A, in such manner that the cover panel 20A is pivotally and rearwardly pulled to fold at the opened position. Conversely, after a predetermined time period, the electric motor 42A is deactivated to release the rotation force of the driving pulley 43A. Therefore, once the pulling force of the cover panel 20A is released by actuation unit 40A, the cover panel 20A is pivotally folded at vertical orientation at the closed position by the weight of the cover panel 20A. In order words, the cover panel 20A is being pivotally and rearwardly pulled to open the container opening 12A for communicating with the receiving cavity 11A. When the target movement is disappeared, the sensor 41A outputs a signal to the actuation unit 40A to release the pulling force to close the cover panel 20A at the vertical closed position.

The container body 10A further has a front door 14A provided at a receiving opening, which is provided at the lower front side of the container body 10A, wherein the front door 14A is pivotally and vertically coupled with one of a vertical edge of the receiving opening for being fold to align with the front side of the container body 10A to form an integrated front wall at a closed position and unfold to outwardly open for communicating with the receiving cavity 11A at an opened position, in such manner that, an extra container, such as a trash can or a basket, is capable of incorporating with the receiving cavity 11A of container body 10A for receiving the predetermined objects through the container opening 12A.

Take the trash can for example, when the front door 14A is being unfolded to open the front door 14A, the extra container is capable of putting into the receiving cavity 11A of the container body 10A for receiving purpose, or taking out from the receiving cavity 11A when the predetermined objects received in the extra container in the receiving cavity 11A is full. When the front door 14A is folded to close the front door 14A, the extra container is enclosed in the receiving cavity 11A of the container body 10A, so as to prevent any smells out from the receiving cavity 11A or flies flying around the objects, such as trash received in the extra container.

The top wall 13A of the container body 10A is slightly and frontwardly extruded out to form an area for mounting the sensor 41A thereunderneath and above the cover panel 20A at the container opening 12A, so that the sensor mounted underneath the top wall 13A is capable of preventing the detection of unwanted target movement. A rim 132A is further provided at the peripheral edge of the top wall 13A, in which the rim is upwardly extended from a left, right, and rear peripheral edge of the top wall 13A to form an up-side-down U shape and define a compartment therewithin, so that the compartment is capable of securely putting an object thereon.

It is appreciated that, take the trash can in a food court as example, the up-side-down U shape containing compartment on the top of the top wall 13A is capable for slidably receiving a food tray on the top of the top wall 13A, so that after the receiving cavity 11A of the container body 10A received the predetermined objects, such as beverage containers on the top of food tray, the user is able to put the food tray on the containing compartment formed within the upwardly extended rim, which has a size and the shape for stably receiving the tray thereon.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A container, comprising:

a container body having a receiving cavity and a container opening communicating with said receiving cavity;

a cover panel movably coupled mounted at said container body at said container opening to fold between a closed position that said cover panel is folded to enclose said receiving cavity and an opened position that said cover panel is folded to expose said receiving cavity through said container opening;

an induction actuation system, comprising:

an actuation unit supported in said container body to automatically drive said cover panel moving between said closed position and said opened position in responsive to a presence of a user; and a power recharging arrangement which comprises a battery unit detachably supported by said container body, wherein said battery unit is mounted at said container body to electrically connect to said actuation unit for resuming proper operation thereof and is detached from said container body for recharging purpose, wherein said battery unit comprises a battery housing mounted at said container body, a power circuit sealed and received in said battery housing to electrically pre-wire with said actuation unit, and a rechargeable battery cell detachably disposed in said battery housing to electrically and detachably connect to said power circuit in such a manner that when said rechargeable battery cell is electrically disconnected to said power circuit, said rechargeable battery cell is adapted to detach from said battery housing for recharging purpose.

2. The container, as recited in claim 1, wherein said rechargeable battery cell comprises a power plug electrically and detachably connected to a power slot of said power circuit for electrically connecting to said actuation unit, and arranged to be detached from said power slot of said power circuit for electrically connecting to an external power source for recharging purpose.

3. The container, as recited in claim 1, wherein said battery housing comprises a housing base, having an accessing opening, securely attached to said container body and a housing cover operatively mounted at said accessing opening of said housing base to seal and enclose said power circuit and said rechargeable battery cell in said housing base.

4. The container, as recited in claim 2, wherein said battery housing comprises a housing base, having an accessing opening, securely attached to said container body and a housing cover operatively mounted at said accessing opening of said housing base to seal and enclose said power circuit and said rechargeable battery cell in said housing base.

5. The container, as recited in claim 2, wherein said battery unit is mounted at an outer side of said container unit at a position out of said receiving cavity.

6. The container, as recited in claim 4, wherein said battery unit is mounted at an outer side of said container unit at a position out of said receiving cavity.

7. The container, as recited in claim 1, wherein said battery unit is mounted on top of a top wall of said container body, wherein said actuation unit is mounted underneath said top wall of said container body at a position in a vicinity of said battery unit, such that said battery unit is electrically coupled with said actuation unit through said top wall to minimize a distance of electrical connection between said battery unit and said actuation unit.

8. The container, as recited in claim 5, wherein said battery unit is mounted on top of a top wall of said container body, wherein said actuation unit is mounted underneath said top wall of said container body at a position in a vicinity of said battery unit, such that said battery unit is electrically coupled with said actuation unit through said top wall to minimize a distance of electrical connection between said battery unit and said actuation unit.

9. The container, as recited in claim 6, wherein said battery unit is mounted on top of a top wall of said container body, wherein said actuation unit is mounted underneath said top wall of said container body at a position in a vicinity of said battery unit, such that said battery unit is electrically coupled with said actuation unit through said top wall to minimize a distance of electrical connection between said battery unit and said actuation unit.

10. The container, as recited in claim 8, wherein said top wall of said container body has at least a through communication slot formed thereat, wherein said battery unit further comprises a connection cable electrically extended from said power circuit to detachably and electrically connect to said actuation unit through said communication slot.

11. The container, as recited in claim 9, wherein said top wall of said container body has at least a through communication slot formed thereat, wherein said battery unit further comprises a connection cable electrically extended from said power circuit to detachably and electrically connect to said actuation unit through said communication slot.

12. The container, as recited in claim 6, wherein said container opening is front opening formed at an upper front side of said container body, wherein said cover panel is pivotally coupled with said container body at said container opening, and is arranged to pivotally and rearwardly fold into said container body at said opened position to communicate said container opening with said receiving cavity at a bottom portion of said container body and to pivotally fold at vertical orientation at said closed position so as to enclose said container opening.

13. The container, as recited in claim 9, wherein said container opening is front opening formed at an upper front side of said container body, wherein said cover panel is pivotally coupled with said container body at said container opening, and is arranged to pivotally and rearwardly fold into said container body at said opened position to communicate said container opening with said receiving cavity at a bottom portion of said container body and to pivotally fold at vertical orientation at said closed position so as to enclose said container opening.

14. The container, as recited in claim 11, wherein said container opening is front opening formed at an upper front side of said container body, wherein said cover panel is pivotally coupled with said container body at said container opening, and is arranged to pivotally and rearwardly fold into said container body at said opened position to communicate said container opening with said receiving cavity at a bottom portion of said container body and to pivotally fold at vertical orientation at said closed position so as to enclose said container opening.

15. The container, as recited in claim 12, wherein said induction actuation system further comprises a sensor mounted underneath said top wall of said container body at said container opening thereof for detecting presence of said user in front of said container body so as to automatically activate said actuation unit.

16. The container, as recited in claim 13, wherein said induction actuation system further comprises a sensor mounted underneath said top wall of said container body at said container opening thereof for detecting presence of said user in front of said container body so as to automatically activate said actuation unit.

17. The container, as recited in claim 14, wherein said induction actuation system further comprises a sensor mounted underneath said top wall of said container body at said container opening thereof for detecting presence of said user in front of said container body so as to automatically activate said actuation unit.

* * * * *